United States Patent [19]

Kikuchi et al.

[11] 4,361,505

[45] Nov. 30, 1982

[54] PROCESS FOR TREATING RADIOACTIVE WASTE

[75] Inventors: Makoto Kikuchi; Koichi Chino; Fumio Kawamura, all of Hitachi; Hideo Yusa, Katsuta, all of Japan

[73] Assignee: Hitachi, Ltd., Tokyo, Japan

[21] Appl. No.: 117,089

[22] Filed: Jan. 31, 1980

[30] Foreign Application Priority Data

Feb. 2, 1979 [JP] Japan ..... 54-10442

[51] Int. Cl.[3] ..... G21F 9/16

[52] U.S. Cl. ..... 252/628; 252/632; 264/0.5

[58] Field of Search ..... 252/628, 632; 556/424; 264/0.5

[56] References Cited

U.S. PATENT DOCUMENTS 3,988,258 10/1976 Curtiss ..... 252/301.1 W

FOREIGN PATENT DOCUMENTS 50-93865 7/1975 Japan .

OTHER PUBLICATIONS

Plueddemann, "Adhesion Through Silane Coupling Agents", 25th Ann. Tech. Conf., 1970, Reinforced Plastics/Composites Div., *The Society of the Plastics Industry, Inc.,* Section 13-D, pp. 1-10.

Plueddemann, "Mechanism of Adhesion . . .", *J. of Paint Tech.,* vol. 42, No. 550, Nov. 1970, pp. 600-608.

*Primary Examiner*—Deborah L. Kyle

*Attorney, Agent, or Firm*—Antonelli, Terry & Wands

[57] ABSTRACT

N-$\beta$-(aminoethyl)-$\gamma$-aminopropyltrimethoxysilane $[NH_2(CH_2)_2NH(CH_2)_3Si(OCH_3)_3]$ as a silane coupling agent and $SiO_{(2-x)}(ONa)_{x/2}(OH)_{x/2}$ as colloidal silica are mixed into a radioactive liquid waste containing sodium sulfate as a main component, coming from a boiling water-type, nuclear power plant as an effluent. The resulting mixed radioactive liquid waste is supplied into a vessel provided with a rotating shaft with blades. The rotating shaft is revolved while heating the radioactive liquid waste in the vessel, thereby making the radioactive liquid waste into powder. The resulting powder containing the silane coupling agent and the colloidal silica is shaped into pellets by a pelletizer. The pellets having a low hygroscopicity and a high strength are obtained.

12 Claims, 10 Drawing Figures

PROCESS FOR TREATING RADIOACTIVE WASTE

BACKGROUND OF THE INVENTION

This invention relates to a process for treating a radioactive waste, and more particularly to a process for treating a radioactive liquid waste, suitable for shaping pellets having a low hygroscopicity.

Heretofore, radioactive liquid wastes produced in radioactive material handling facilities of nuclear power plants, etc. have been classified according to their characteristics, and treated or stored. For example, a large amount of radioactive liquid wastes in a solution state produced in boiling water-type nuclear power plants, such as a liquid waste resulting from regeneration of ion exchange resin, which contains sodium sulfate ($Na_2SO_4$) as a main component, etc. is solidified by cement or asphalt in drums. Used ion exchange resin, filter aid, etc. are stored in tanks in a slurry state. Thus, in order to reduce storage space, attempts have so far been made to dry the radioactive liquid waste in the slurry state into powder by a drier such as a thin film drier, etc., then pelletize the powder into pellets by a pelletizer such as a briquetting machine, etc., and storing the pellets, thereby reducing a considerable volume of the radioactive wastes coming from the nuclear power plants as the effluent. In that case, it is necessary to prevent the pellets from breakage or scattering as powder, etc. at the transportation or handling such as the filling into drums, etc.

Japanese Laid-open Patent Application Specification No. 93865/75 (laid open on July 26, 1975) discloses a process for treating a radioactive liquid waste by means of a binder so as to increase the strength of the pellets, where a radioactive liquid waste containing the binder is dried into powder by a spray drier, the powder is shaped into pellets, and the pellets are stored in storage tanks.

A process for treating a radioactive liquid waste to reduce the number of drums containing pellets solidified by asphalt is proposed in Japanese Laid-open Patent Application Specification No. 34200/77 (laid open on Mar. 15, 1977), where a radioactive liquid waste is made into powder, the powder is shaped into pellets, the pellets are stored for a specific period, and the pellets whose radioactivity is reduced by the storage are filled into drums, and solidified by asphalt. According to said process, number of pellets to be filled in a drum can be increased, and thus the number of the required drums can be reduced, as compared with the case of filling the pellets into drums immediately after the shaping. However, the stability of pellets must be maintained during the storage, and it is necessary to prevent the pellets from deliquescence, moisture absorption, etc. However, the pellets prepared according to the conventional processes are very unsatisfactory in meeting said requirements.

To overcome these disadvantages, a process of impregnating pellets with a liquid plastic monomer such as styrene monomer, adding a polymerization initiator such as benzoyl peroxide thereto, and polymerizing the monomer is proposed in Japanese Patent Publication No. 8880/78 (published on Apr. 1, 1978), where an apparatus for impregnating the pellets with the liquid plastic monomer and the polymerization initiator is required, which complicates the system, and furthermore it is difficult to impregnate the individual pellets with the liquid plastic monomer and the polymerization initiator continuously and rapidly. For example, the impregnation will be quite inefficient when carried out one by one, and the number of the pellets waiting for the impregnation is increased. Furthermore, when the polymerization is carried out while placing the pellets, for example, on a plate, the pellets themselves will adhere to the plate, and when a plurality of the pellets are in contact with one another, the plurality of the pellets will adhere to one another. Thus, the handling must be inevitably made with much care.

SUMMARY OF THE INVENTION

An object of the present invention is to shape pellets of radioactive waste with a low hygroscopicity.

Another object of the present invention is to shape pellets of radioactive waste with a high strength.

Other object of the present invention is to shape pellets with a high strength and a low hygroscopicity without increasing the amount of radioactive waste.

The present invention is characterized by mixing a binder containing silicon into a radioactive liquid waste, the binder being soluble or dispersible in the radioactive liquid waste, then making the radioactive liquid waste into powder, and shaping the powder containing the binder into pellets. As the binder, a silane coupling agent, which is an organosilicon monomer containing at least two different reactive groups in one molecule, is preferably used. Furthermore, it is desirable to use the silane coupling agent and colloidal silica at the same time.

DESCRIPTION OF THE PREFERRED EMBODIMENTS

Pelletization of radioactive liquid waste proceeds in a process sequence of drying-making powder-pelletization of a liquid waste.

The present invention has been established on the basis of a finding that some binder dissolves in a radioactive liquid waste in a solution state or a slurry state and attain an excellent binding effect in the drying step and the pelletizing step in the process.

Figure 1:
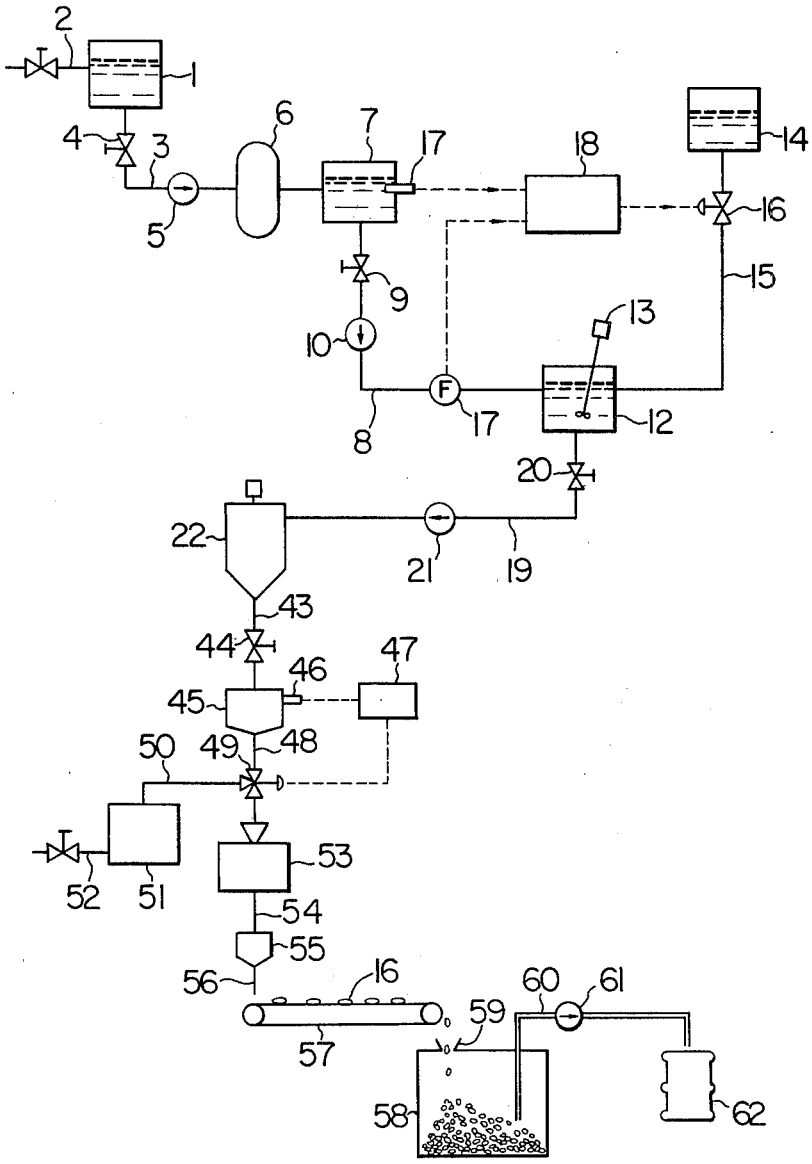
FIG. 1 is a flow sheet of an apparatus for treating a radioactive liquid waste according to one preferable embodiment of the present invention.

A preferable embodiment of the present invention are applied to a boiling water-type nuclear power plant will be described in detail, referring to FIG. 1.

A conduit 2 for introducing a radioactive regeneration liquid waste (main component being sodium sulfate) produced by regenerating granular ion exchange resin in a desalter (not shown in the drawing) is connected to a tank 1. A conduit 3 having one end connected to the tank 1 is connected to a concentrator 6 at another end through a valve 4 and a pump 5. A tank 7 is connected to the concentrator 6. A conduit 8 connects the tank 7 to a mixing tank 12 through a valve 9, a pump 10 and a flow rate meter 11. An agitator 13 is provided in the mixing tank 12. A conduit 15 with a valve 16 connects the mixing tank 12 to a tank 14. A concentration meter 17, for example, an electro-conductivity meter, for measuring a concentration of sodium sulfate is provided at the tank 7. Numeral 18 shows a controller. A conduit 19 connects the mixing tank 12 to a thin film drier 22. A valve 20 and a pump 21 are provided on the conduit 19.

Figure 2:
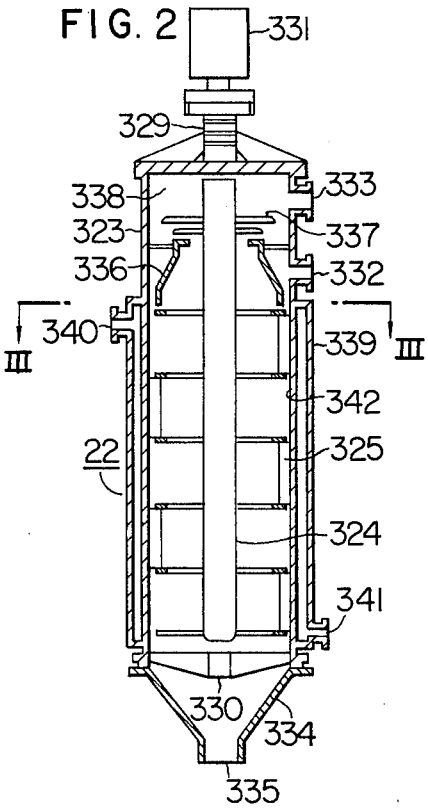
FIG. 2 is a vertical cross-sectional view of a thin film drier.
Figure 3:
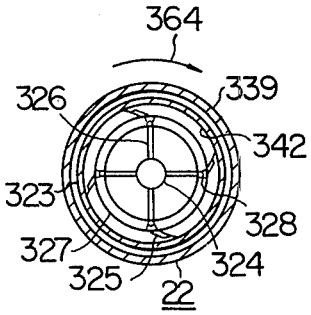
FIG. 3 is a cross-sectional view along line IV—IV of FIG. 2.
Figure 4:
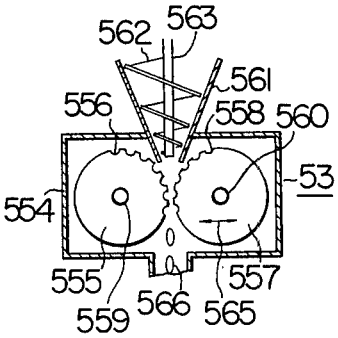
FIG. 4 is a vertical cross-sectional view in detail of a pelletizer shown in FIG. 2.

Detailed structure of the thin film drier 22 will be described below, referring to FIGS. 2 and 3.

The thin film drier 22 is provided with a rotating shaft 324 with pivotally movable blades 325 within a shell 323. The rotating shaft 324 is supported by an upper bearing 329 and a lower bearing 330. A motor 331 is connected to the upper end of the rotating shaft 324. A vapor outlet 333 and a liquid inlet 332 are provided at the upper part of the shell 323. The conduit 19 is connected to the liquid inlet 332. A bottom cone 334 with a powder outlet 335 is provided at the lower part of the shell 323. A mist separator 337 and a distributor 336 are arranged at the upper part of the shell 323 to form a vapor chamber 338. The distributor 336 and the mist separator 337 are fixed to the shell 323. A jacket 339 is provided around the shell 323 to surround the shell 323, and is provided with a heating medium inlet 340 and a heating medium outlet 341. The pivotally movable blades 325 are pivotally movably fixed by pins 328 to support rings 327 fixed to the rotating shaft 324 by support arms 326.

A conduit 43 connected to the powder outlet 335 of the thin film drier 22 is connected to a powder hopper 45 through a valve 44. A moisture meter 46 is provided at the powder hopper 45. Numeral 47 shows a controller. A conduit 48 having one end fixed to the bottom of the powder hopper 45 is connected to a pelletizer 53 at another end through a three-way valve 49. A conduit 50 connects the three-way valve 49 to a tank 51. A conduit 52 is connected to the tank 51.

Detailed structure of the pelletizer 53 will be described below, referring to FIG. 5. The pelletizer 53 has a pair of rolls 555 and 557 within a casing 554. A large number of recesses 556 and 558 exist on the peripheral surfaces of the rolls 555 and 557, and the rolls 555 and 557 are arranged so that their peripheral surfaces can be counterposed to each other. The rolls 555 and 557 are fixed to rotating shafts 559 and 560, respectively. The rotating shafts 559 and 560 are connected to motors (not shown in the drawing), respectively. A rotating shaft-moving device, which can move the rotating shaft 560 in a direction of arrow 565, is provided at the shaft 560, though not shown in the drawing. A hopper 561 is provided at the upper part of the casing 554. A screw feeder 562 is arranged within the hopper 561. A motor (not shown in the drawing) is connected to the upper end of a screw feeder shaft 563. The conduit 48 is inserted into the hopper 561 so as not to interrupt the rotation of the screw feeder 562.

A conduit 54 is provided at the bottom of the casing 554 of the pelletizer 53. The conduit 54 is connected to a pellet hopper 55. A conduit 56 provided at the bottom of the pellet hopper 55 is open over a belt conveyor 57, which is a pellet transfer machine. The belt conveyor 57 extends to a position right above a pellet chute 59 of a storage tank 58 disclosed in U.S. patent application Ser. No. 55,151. A pellet suction conduit 60 with a blower 61 is inserted into the storage tank 58.

The radioactive regeneration liquid waste produced at the regeneration of granular ion exchange resin is introduced into the tank 1 through the conduit 2. The regeneration liquid waste is substantially an aqueous solution of sodium sulfate. The regeneration liquid waste is fed into the concentrator 6 through the conduit 3 by driving the pump 5. The regeneration liquid waste is concentrated in the concentrator 6, and a concentration of sodium sulfate is increased thereby. The regeneration liquid waste whose sodium sulfate concentration has been concentrated to about 20% by weight is led to the tank 7. The concentration of sodium sulfate in the regeneration liquid waste is measured by the concentration meter 17. A concentration signal thus obtained is transmitted to the controller 18. The regeneration liquid waste in the tank 7 is fed into the mixing tank 12 through the conduit 8 by driving the pump 10. A flow rate of the regeneration liquid waste is measured by the flow rate meter 11. A flow rate signal thus obtained is transmitted to the controller 18. The controller 18 determines an absolute amount of sodium sulfate supplied to the mixing tank 12 from a product of the concentration signal and the flow rate signal. An aqueous 20 wt.% solution of N-$\beta$-(aminoethyl)-$\gamma$-aminopropyltrimethoxysilane [$NH_2(CH_2)_2NH(CH_2)_3Si(OCH_3)_3$], which is a kind of the silane coupling agent, is in the tank 14. $OCH_3$ of $NH_2(CH_2)_2NH(CH_2)_3Si(OCH_3)_3$ is converted to OH by hydrolysis. The aqueous solution of $NH_2(CH_2)_2NH(CH_2)_3Si(OCH_3)_3$ is supplied to the mixing tank 12 through the conduit 15 by opening the valve 16. The degree of opening of the valve 16 is controlled in accordance with the absolute amount of sodium sulfate by the controller 18. That is, if the absolute amount of sodium sulfate is increased, the degree of opening of the valve 16 is increased.

Figure 6:
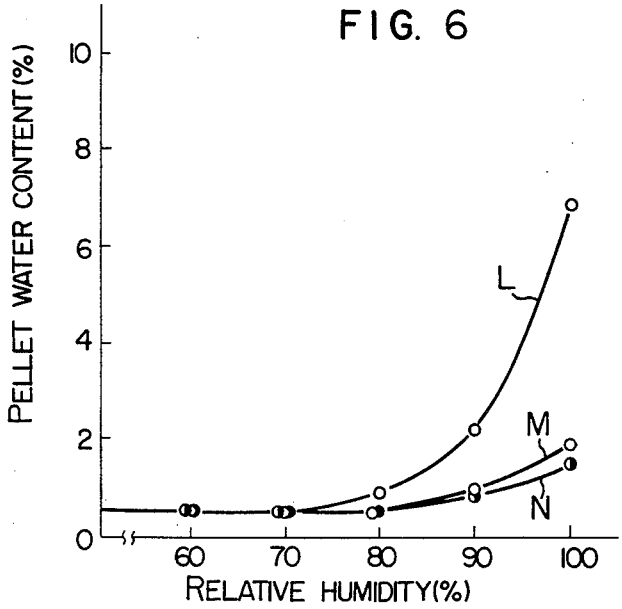
FIG. 6 is a characteristic diagram showing relations between relative humidity and pellet water content.

Relations between the content of $NH_2(CH_2)_2NH(CH_2)_3Si(OCH_3)_3$ in pellets formed by adding $NH_2(CH_2)_2NH(CH_2)_3Si(OCH_3)_3$ and percent pellet fall breakage are shown in FIG. 6, where the percent pellet fall breakage shows a percentage of pellets broken when the pellets containing $NH_2(CH_2)_2NH(CH_2)_3Si(OCH_3)_3$ is made to fall from the height of 3 m. When the content of $NH_2(CH_2)_2NH(CH_2)_3Si(OCH_3)_3$ in the pellets exceeds 2% by weight, the pellets are hardly broken. However, an increase in the amount of the silane coupling agent in the pellets means a corresponding increase in the amount of the radioactive waste, or the number of drums, and thus it is desirable that the amount of the silane coupling agent to be added is smaller. Preferably the amount of the silane coupling agent is 2% by weight.

The controller 18 opens the valve 16 in accordance with the concentration of sodium sulfate and the absolute amount of sodium sulfate supplied to the mixing tank 12 and supplies the aqueous solution of $NH_2(CH_2)_2NH(CH_2)_3Si(OCH_3)_3$ to the mixing tank 12 so that 2% by weight of $NH_2(CH_2)_2NH(CH_2)_3Si(OCH_3)_3$ as the silane coupling agent can be contained in the pellets. The regeneration liquid waste and the aqueous solution of $NH_2(CH_2)_2NH(CH_2)_3Si(OCH_3)_3$ are stirred and mixed in the mixing tank 12 by the stirrer 13. The regeneration liquid waste containing $NH_2(CH_2)_2NH(CH_2)_3Si(OCH_3)_3$ is supplied into the thin film drier 22 from the liquid inlet 332 through the conduit 19 by driving the pump 21.

The regeneration liquid waste is supplied into the inside of the shell 323 from the liquid inlet 332, uniformly distributed in a circumferential direction by the distributor 336, and made to flow down along the inside surface of the shell 323 by gravity. The rotating shaft 324 is revolved in the direction of arrow 364.

The pivotally rotatable blades 325 are also moved in the direction of arrow 364 with the revolution of the rotating shaft 324. At that time, the pivotally rotatable blades 325 can be rotated around the pins 328 as centers, and thus can be extended outwardly by the action of centrifugal force. Thus, the tip ends of the pivotally rotatable blades 325 move in contact with the inside surface of the shells 323.

The regeneration liquid waste flowing down along the inside surface of the shell 323 is pressed onto the inside surface of the shell 323 by the centrifugal force caused by the movement of the pivotally rotatable blades 325 in the direction of arrow 363. On the other hand, steam under 7 atmospheres is supplied into an annular space formed by the shell 323 and the jacket 339 from the heating medium inlet 340. The steam flows from the heating medium outlet 341. The wall surface of the shell 323 surrounded by the jacket 339 is heated by the steam. The wall surface is a heat transfer surface 342. While the regeneration liquid waste flows down along the heat transfer surface 342, water is evaporated from the regeneration liquid waste. The resulting water vapor flows from the vapor outlet 333 through the vapor chamber 338.

Sodium sulfate in the regeneration liquid waste is deposited while the water is evaporated from the regeneration liquid waste, and made into powder by the action of rotating pivotally rotatable blades 325. Sodium sulfate and $NH_2(CH_2)_2NH(CH_2)_3Si(OCH_3)_3$ undergo a condensation reaction in the thin film drier 12, particularly at its lower part, and chemical bond each other. The powder of sodium sulfate bonded to $NH_2(CH_2)_2NH(CH_2)_3Si(OCH_3)_3$ is taken out of the thin film drier 22 from the powder outlet 335.

The powder is led to the powder hopper 45 through the conduit 43. Water content of the powder in the powder hopper 45 is measured by the moisture meter 46. If the moisture content of the powder is below the set value, the three-way valve 49 is operated by the function of the controller 47, whereby the powder hopper 45 is connected to the pelletizer 53. The powder in the powder hopper 45 is supplied into the hopper 561 of the pelletizer 53 through the conduit 48. The screw feeder 562 in the hopper 561 is rotated to feed the powder in the hopper 561 into between a pair of the rolls 555 and 557, which are rotated individually by the driving of motors. The rolls 555 and 557 rotate so that the recesses 556 and 558 on the peripheral surfaces of the individual rolls can face each other. The powders supplied by the screw feeder 562 is supplied to the recesses 556 and 558. When the recesses 556 and 558 come to each other most closely by the rotation of the individual rolls, that is, when the recesses 556 and 558 face each other, the powder is compressed most compactly. Almond-shaped pellets 566 are shaped by said pelletizing action. Sodium sulfate in the pellets 566 forms a cross-linked structure, as shown by C of FIG. 1. The amount of $NH_2(CH_2)_2NH(CH_2)_3Si(OCH_3)_3$ in the pellets 566 is 2% by weight. The pellets 566 fall into the pellet hopper 55 through the conduit 54.

When the water content of the powder in the powder hopper 45 is higher than the set value, the three-way valve 49 is operated by the controller 47, whereby the conduit 48 is connected to the conduit 50. Naturally, the operation of the thin film drier 22 is discontinued. The powder having a higher water content than the set value is dissolved in washing water supplied into the powder hopper 45, and discharged into the tank 51 through the conduit 50 without being fed to the pelletizer 53. The solution of sodium sulfate in the tank 51 is returned to the tank 1 through the conduit 52, and retreated. After the powder has been discharged from the powder hopper 45, the inside of the powder hopper 45, etc. is dried, and then the thin film drier 22 is restarted.

The pellets 566 in the pellet hopper 55 are supplied onto the belt conveyor 57 through the conduit 56, and the belt conveyor 57 transports the pellets 566 to the pellet chute 59 of the storage tank 58. The pellets 566 are placed into the storage tank 58 from the pellet chute 59, and stored in the storage tank 58 for a definite period until the ratioactivity is decayed. The pellets 566 whose radioactivity has been decayed to a desired value is discharged from the storage tank 58 by suction through the pellet suction conduit 60 by driving the blower 61, and filled into the drum 62. Asphalt is poured into the drum 62 filled with the pellets 566, and the drum 62 is tightly sealed after the solidification of asphalt.

Figure 7:
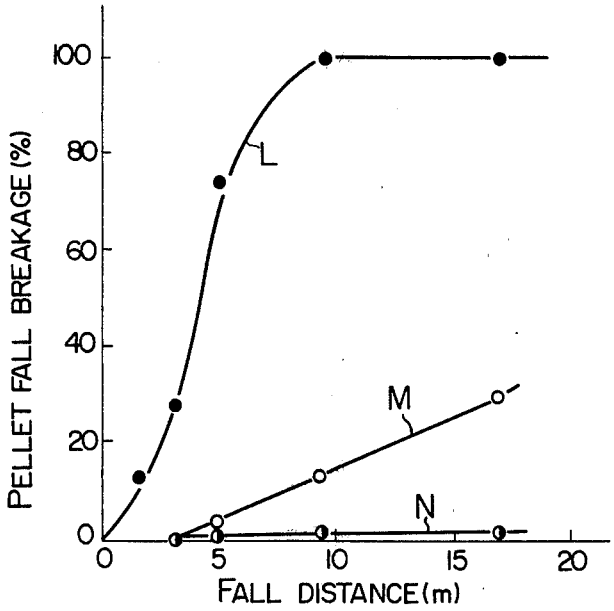
FIG. 7 is a characteristic diagram showing relations between fall distance and percent pellet fall breakage.
Figure 8:
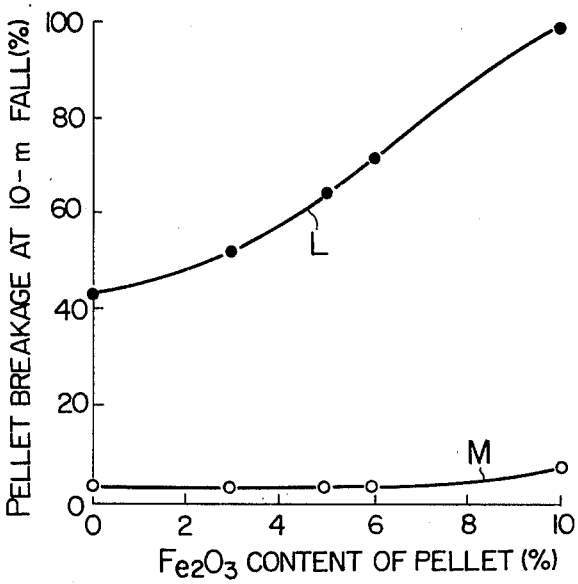
FIG. 8 is a characteristic diagram showing relations between $Fe_2O_3$ content of pellets and percent pellet breakage.
Figure 9:
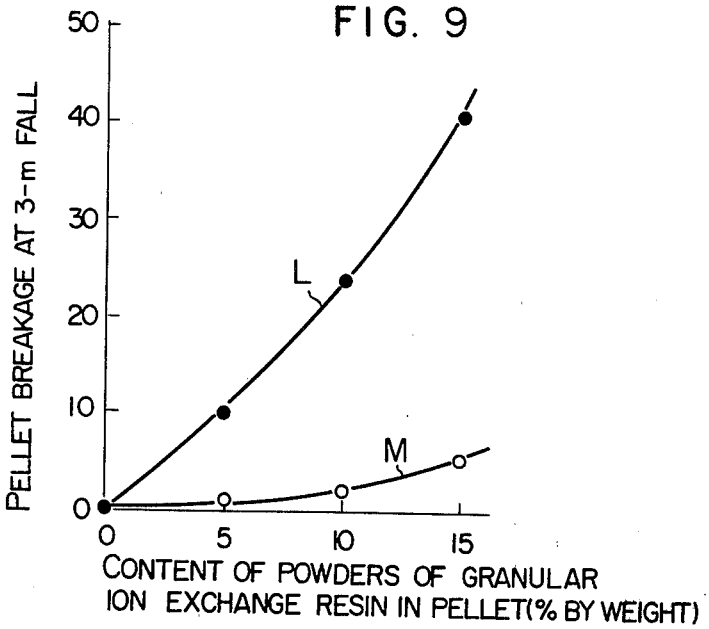
FIG. 9 is a characteristic diagram showing relations between content of powder of granular ion exchange resin in pellets and percent pellet breakage.

Characteristics of the pellets 566 shaped according to the present invention are shown in FIGS. 6, 7 and 8, where a curve L shows the characteristics of conventional pellets containing no binder, a curve M shows the characteristics of pellets obtained by adding $NH_2(CH_2)_2NH(CH_2)_3Si(OCH_3)_3$, silane coupling agent, as a binder according to the present invention, and a curve N shows the characteristics of pellets obtained by adding $NH_2(CH_2)_2NH(CH_2)_3Si(OCH_3)_3$ and $SiO_{(2-x)}(ONa)_{x/2}(OH)_{x/2}$, colloidal silica, as binders according to the present invention, as will be described later. The content of the binder in the pellets is 2% by weight. Description will be made from FIG. 7.

FIG. 6 shows changes in the water content of the individual pellets when the pellets are maintained in the atmospheres of the individual relative humidities for 400 hours. As is obvious from the comparison of the curve L with the curve M, the water content of the pellets obtained by adding the silane coupling agent according to the present invention is considerably lower even in the atmosphere of 100% relative humidity than that of the conventional pellets containing no binder. The hygroscopicity of the pellets according to the present invention is considerably low, and the deliquescence can be prevented. Furthermore, when the pellets prepared according to the present invention are stored in a storage tank as described in U.S. patent application Ser. No. 55,151 for a long period of time, conditions for controlling the pellets can be made milder.

FIG. 7 shows relations between the fall distance and the percent fall breakage of pellets. The percent fall breakage of the pellets obtained by adding the silane coupling agent according to the present invention is considerably lower than that of the conventional pellets containing no binder. For example, at a fall distance of 15 m, the latter is 100% broken, whereas the former is only about 25% broken.

FIG. 8 shows relations between the $Fe_2O_3$ content of pellets and percent pellet breakage at a fall distance of 10 m. Curves L and M show an increasing tendency of percent pellet breakage with increasing $Fe_2O_3$ content, but the increasing tendency of the percent breakage of the pellets according to the present invention with increasing $Fe_2O_3$ content is considerably lower than that of the conventional pellets containing no binder, and the percent breakage itself of pellets according to the present invention is considerably low.

The addition of a binder means an increase of pellet volume, and is not preferable from the viewpoint of reducing the volume of radioactive waste, as described above. However, in the case of adding 2% by weight of a binder as in the foregoing example of the present invention, a density is increased, but a volume is hardly increased, as shown in the following Table 1, and thus the addition of a binder gives no adverse effect upon the volume reduction ratio.

TABLE 1

| | Pellets containing binder | Pellets containing no binder |
|---|---|---|
| Amount of binder added (% by weight) | 2 | 0 |
| Density (g/cm$^3$) | 2.40 | 2.35 |
| Weight (g/pellet) | 9.0 | 8.8 |

In the case of using a silane coupling agent having reactive groups that will be converted to hydroxyl group by hydrolysis when dissolved in water as described above, the hydroxyl groups attached to the surface of sodium sulfate and the hydroxyl groups formed by the hydrolysis of said reactive groups undergo dehydrating condensation reaction in the drying step and evaporate as water, and thus the amount of the silane coupling agent in the pellets is decreased correspondingly. Thus, in the case of using the silane coupling agent having the reactive groups that will be converted to the hydroxyl groups by hydrolysis, the effect upon the volume reduction ratio is much less than the cases of using other silane coupling agents.

In the foregoing example of the present invention, N-$\beta$-(aminoethyl)-$\gamma$-aminopropyltrimethoxysilane [$NH_2(CH_2)_2NH(CH_2)_3Si(OCH_3)_3$], a silane coupling agent having an amino group, is used as the binder, but other silane coupling agents such as vinyltrichlorosilane [$CH_2{=}CHSiCl_3$], vinyl-tris-($\beta$-methoxyethoxy)-silane [$CH_2{=}CHSi(OCH_2H_4OCH_3)_3$], $\gamma$-mercaptopropyltrimethoxysilane [$HSC_3H_6Si(OCH_3)_3$], etc. are applicable with similar effects to that when $NH_2(CH_2)_2NH(CH_2)_3Si(OCH_3)_3$ is used. However, in the case of water-insoluble silane coupling agents such as $\gamma$-methacryloxypropyltrimethoxysilane $$[CH_2{=}\overset{\overset{\displaystyle CH_3}{|}}{C}{-}\underset{\underset{\displaystyle O}{\|}}{C}{-}O{-}C_3H_6Si(OCH_3)_3],$$

etc., they must be dispersed into water by means of a surfactant. The addition of surfactant decreases the volume reduction of the radioactive liquid waste correspondingly. Among the silane coupling agents, the binding force (to sodium sulfate) of silane coupling agents having an amino group is strongest.

As other binders than the silane coupling agent, inorganic binders such as aluminum phosphate, colloidal silica, etc., cellulose binders, emulsified teflon, etc. as shown in the following Table 2 are available, but have advantages and disadvantages at the same time. In the case of adding an emulsion to the regeneration liquid waste, a surfactant must be added.

TABLE 2

Comparison of binders

| Binder | Application Example | Property | Percent* breakage (%) | Percent** water absorption |
|---|---|---|---|---|
| None | — | — | 21 | 5 |
| Aluminum phosphate | Brick | Water-soluble | 1 | 10 |
| cellulose | Fertilizer | Emulsion | 15 | 3 |
| teflon | water-proof fabric | " | 20 | 0.1 |
| silane coupling agent | Reinforced plastic | Water-soluble | 3 | 2 |

Figure 10:
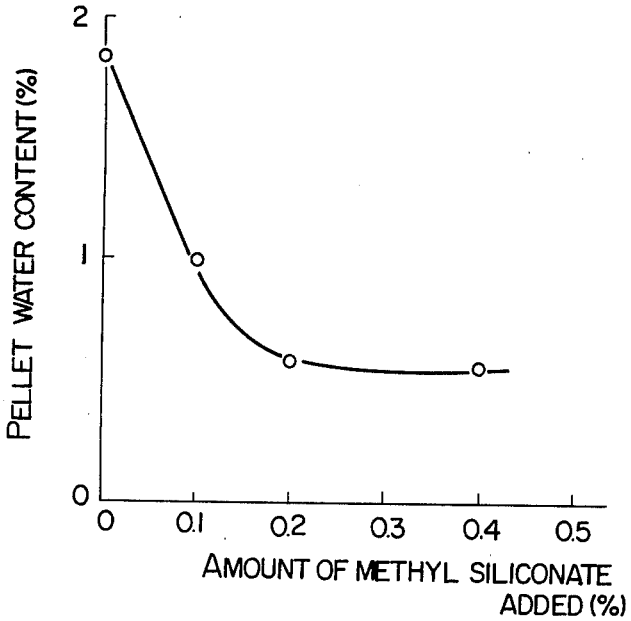
FIG. 10 is a characteristic drawing showing relations between the amount of methyl siliconate and pellet water content.

*Percent breakage at a fall distance of 6 m when 2% by weight of the respective binder was added.
Humidty: 90%, time for being left standing: 400 hours In the foregoing example of the present invention, the regeneration liquid waste containing sodium sulfate is treated, but radioactive liquid wastes in a slurry state such as granular ion exchange, powdery resin, cellulose powder, etc. can be also treated with the similar effect. Particularly, the functional group of the silane coupling agent is generally very reactive with the resins such as plastics, etc., and thus has a considerable effect. As one example of the effect, the influence of ion exchange resin is shown in FIG. 10, where a case of mixing the regeneration liquid waste containing sodium sulfate as a main component with used granular ion exchange resin is exemplified. The granular ion exchange resin can be also made into powder by the thin film drier. Curve M shows the characteristic of pellets containing 2% by weight of $NH_2(CH_2)_2NH(CH_2)_3Si(OCH_3)_3$ as a silane coupling agent. It is obvious from FIG. 10**, the percent breakage of the pellets according to the present invention is considerably lower in the case of treating the granular ion exchange resin according to the present invention than that of the conventional pellets containing no binder, as shown by curve L. The hygroscopicity of the pellets according to the present invention is also considerably low. However, when the ratio of the powder of granular ion exchange resin is increased, there is an increasing tendency of the percent breakage of the formed pellets.

Figure 5:
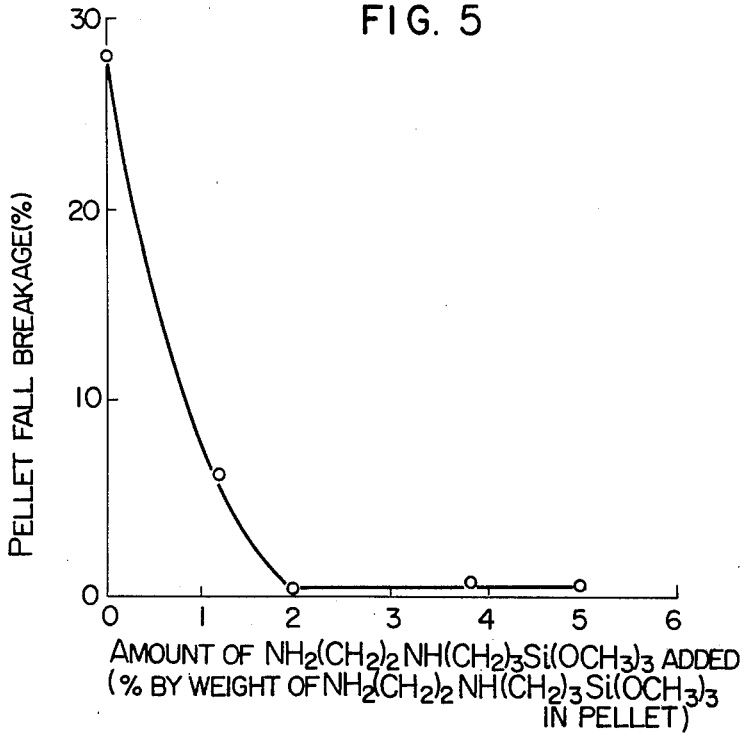
FIG. 5 is a characteristic diagram showing relations between the amount of $NH_2(CH_2)_2NH(CH_2)_3Si(OCH_3)_3$ and percent pellet fall breakage.

In the foregoing example, 2% by weight of the binder is selected as an optimum amount to be added, as shown in FIG. 5, but the optimum amount generally depends upon the physical properties of solid matters. The larger the amount of inorganic substances contained, the larger the amount of a binder to be added. It is natural to add a larger amount of the binder to form stronger pellets, but as a result the amount of the waste is disadvantageously increased.

An example according to FIG. 11 will be described below.

A mixture of a silane coupling agent $NH_2(CH_2)_2NH(CH_2)_3Si(OCH_3)_3$ and colloidal silica $SiO_{(2-x)}(ONa)_{x/2}(OH)_{x/2}$ at a mixing ratio of the colloidal silica to the silicone coupling agent of 0.1–1 by weight is used as a binder. The binder is supplied in a state of aqueous solution from the tank 14 in FIG. 1 into the mixing tank 12 to be mixed with the regeneration liquid waste 2 containing sodium sulfate as a main component in the same manner as in the foregoing example. Successive treatment is carried out in the same manner as shown in FIG. 1. The characteristics of the pellets obtained according to the present example are shown by the curve N in FIGS. 6 and 7. As is evident from FIGS. 6 and 7, the hygroscopicity of the pellets is further lowered and the strength is considerably increased in the case of using the mixture of the silane coupling agent and the colloidal silica as the binder, as compared with the case of using the silane coupling agent only as the binder.

According to another embodiment of the present invention, a silane coupling agent, colloidal silica, and methyl siliconate $[CH_3Si(ONa)_3]$ of organosilicon group, which is alkyl silanol, as a third component are used as the binder. Methyl siliconate is mixed into the mixture of the silane coupling agent and the colloidal silica at a mixing ratio of the methyl siliconate to the mixture of 0.1–1. The binder is supplied into the mixing tank 10 of FIG. 12 to be mixed with the regeneration liquid waste containing sodium sulfate as a main component. Successive treatment is carried out in the same manner as in FIG. 2. Characteristics of the pellets obtained according to the present example are shown in FIG. 10, where the pellets are maintained in the atmosphere of 100% relative humidity for 400 hours. It is obvious from FIG. 12 that the hygroscopicity of the pellets is considerably lowered.

The present invention is also applicable to the treatment of a liquid waste containing sodium borate ($Na_2B_4O_7$) produced from other type of nuclear power plants such as a pressurized water type nuclear power plant, etc., or to the treatment of a liquid waste containing sodium nitrate ($NaNO_3$) as a main component, produced from a nuclear fuel reprocessing plant. When these liquid wastes containing the silane coupling agent are made into powder, and when the resulting powder is pelletized, the pellets have almost same characteristics as those of the pellets obtained when the liquid waste containing sodium sulfate as a main component is treated.

According to the present invention, the hygroscopicity of the pellets is considerably lowered.

What is claimed is:

1. A process for treating a radioactive waste, which comprises mixing a radioactive liquid waste produced from radioactive material handling facilities with at least 2% by weight of a binder based on solid matter in the radioactive waste, said binder comprising an organosilicon monomer containing at least two different reactive groups in one molecule and being soluble or dispersible in the radioactive liquid waste, then drying the radioactive liquid waste containing said binder into powder, and shaping the powder containing the binder into pellets.

2. A process according to claim 1, wherein the radioactive liquid waste is mixed with an organosilicon monomer having a reactive group that is converted to a hydroxyl group by hydrolysis when dissolved in water and an organic functional group.

3. A process according to claim 2, wherein the radioactive liquid waste containing the binder is supplied into a vessel provided with a rotating shaft with blades therein, and the rotating shaft is revolved while heating the radioactive liquid waste, thereby making the radioactive liquid waste into powder.

4. A process according to claim 3, wherein the radioactive liquid waste is a radioactive liquid waste containing a sodium salt as a main component, and the radioactive liquid waste containing the sodium salt as a main component is mixed with the binder.

5. A process according to claim 2 or 4, wherein organosilicon monomer has an amine group.

6. A process according to claim 1, wherein the binder comprises said organosilicon monomer and colloidal silica in a mixing ratio of colloidal silica to the monomer of 0.1 to 1.

7. A process according to claim 6, wherein the the liquid organosilicon monomer has a reactive group that is converted to a hydroxyl group by hydrolysis when dissolved in water and an organic functional group.

8. A process according to claim 6, wherein the radioactive liquid waste containing the binder is supplied into a vessel provided with a rotating shaft with blades therein, and the rotating shaft is revolved while heating the radioactive liquid waste, thereby making the radioactive liquid waste into powder.

9. A process according to claim 8, wherein the radioactive liquid waste is a radioactive liquid waste containing a sodium salt as a main component, and the radioactive liquid waste containing the sodium salt as a main component is mixed with the silane coupling agent.

10. A process according to claim 6, 7 or 8, wherein the binder comprises an organosilicon monomer having an amine group.

11. A process according to claim 6, wherein the the binder comprises the organosilicon monomer, colloidal silica and an alkyl silanol at a mixing ratio of the alkyl silanol to the mixture of the organosilicon monomer and the colloidal silica of 0.1–1.

12. A process according to claim 11, wherein the organosilicon monomer has an amine group.

* * * * *